US008389056B1

(12) United States Patent
Cozzolino

(10) Patent No.: US 8,389,056 B1
(45) Date of Patent: Mar. 5, 2013

(54) DECORATIVE ENGINEERED BAMBOO PRODUCTS AND METHOD OF MANUFACTURING

(75) Inventor: Michael Cozzolino, Lebanon, NJ (US)

(73) Assignee: COR Engineered Woods LLC, Lebanon, NJ (US)

( * ) Notice: Subject to any disclaimer, the term of this patent is extended or adjusted under 35 U.S.C. 154(b) by 849 days.

(21) Appl. No.: 12/473,729

(22) Filed: May 28, 2009

(51) Int. Cl.
*B05D 5/00* (2006.01)
*B27D 1/00* (2006.01)

(52) U.S. Cl. ..... 427/284; 144/346; 144/348; 144/350

(58) Field of Classification Search ..... 427/284; 144/346, 348, 350
See application file for complete search history.

(56) References Cited

U.S. PATENT DOCUMENTS

| | | | |
|---|---|---|---|
| 108,781 | A | 11/1870 | Hamilton |
| 329,828 | A | 11/1885 | Green |
| 436,041 | A | 9/1890 | Koskul |
| 451,834 | A | 5/1891 | Murch |
| 598,437 | A | 2/1898 | Piver |
| 1,028,703 | A | 6/1912 | Fulton |
| 1,078,776 | A | 11/1913 | Dunton |
| 1,931,650 | A | 10/1933 | Elmendorf |
| 2,037,259 | A | 4/1936 | Murphy et al. |
| 2,118,841 | A | 5/1938 | Elmendorf |
| 3,128,511 | A | 4/1964 | Tibbals |
| 3,209,500 | A | 10/1965 | Bernett |
| 3,282,010 | A | 11/1966 | King |
| 3,365,850 | A | 1/1968 | Marino |
| 3,579,410 | A | 5/1971 | Barrett |
| 3,730,797 | A | 5/1973 | Jensen |
| 3,810,774 | A | 5/1974 | Pittman |
| 3,887,736 | A | 6/1975 | Kaswell |
| 3,905,172 | A | 9/1975 | Blackburn |
| 4,064,301 | A | 12/1977 | Howard |
| 4,204,900 | A | 5/1980 | Kohn |
| 4,208,369 | A | 6/1980 | Kohn |
| RE30,636 | E | 6/1981 | Barnes |
| 4,774,794 | A | 10/1988 | Grieb |
| 4,784,887 | A | 11/1988 | Abendroth |
| 4,890,656 | A | 1/1990 | Ohsumi et al. |
| 5,182,892 | A | 2/1993 | Chase |
| RE34,283 | E | 6/1993 | Barnes |
| 5,322,584 | A | 6/1994 | Severson et al. |
| 6,428,871 | B1 | 8/2002 | Cozzolino |

FOREIGN PATENT DOCUMENTS

| | | |
|---|---|---|
| CN | 99117809.2 | 2/2001 |
| EP | 309356 A | 3/1989 |
| WO | 9810157 | 3/1998 |

*Primary Examiner* — Elena T Lightfoot
(74) *Attorney, Agent, or Firm* — Brian Roffe

(57) ABSTRACT

Decorative engineered bamboo product and a method of forming a decorative engineered bamboo product in which a block of engineered bamboo product is sliced to expose an edge grain formed by edges of strands of bamboo of the product. The slices can be used directly or attached to a substrate. The slices can be further treated to produce additional decorative features. Additives can be introduced to the engineered bamboo product during the manufacture thereof to incorporate decorative elements therein which are made visible by slicing the engineered bamboo product to expose edge grain, inclusive of the cross-section of the additives.

19 Claims, 3 Drawing Sheets

DECORATIVE ENGINEERED BAMBOO PRODUCTS AND METHOD OF MANUFACTURING

FIELD OF THE INVENTION

The present invention relates to a method of manufacturing decorative products from bamboo, and more particularly, to a method of creating a decorative engineered product with an exposed edge or side grain from stranded and compressed bamboo.

BACKGROUND OF THE INVENTION

It has long been known to expose wood and bamboo grain for decorative purposes. Indeed, flooring, walls (paneling) and even furniture including such things as tables, desks, etc., often display wood grain for decorative purposes. The wood grain provides a nice texture and design to the surface of the decorative wood product. Sometimes, the effect of wood grain is obtained through the use of veneers which can be arranged and manipulated to present wood grain designs.

It is also known that the end grain of wood presents a nice design and provides a very resilient surface that makes it desirable for use in flooring. Numerous previous patents disclose methods, and products made by such methods, for creating decorative wood products that feature wood grain.

It has also been known, in the past, to utilize materials other than natural wood products to create floors and other decorative or useful products from other natural materials and from synthetic materials. However, oftentimes, synthetic materials cannot provide the warmth, texture or richness of wood products. Although efforts may be made to attempt to infuse "wood" characteristics into a synthetic material, such efforts heretofore have not been generally successful. It is also known that structural wood products can be engineered effectively for use as structural components such as for the core of doors. Engineered structural wood products are also known as "structural composite lumber" or "SCL." One such engineered structural wood product is manufactured and sold by Weyerhaeuser under the trademark TimberStrand. TimberStrand™ is made by using trees from species of Aspen and Poplar, cleaning and debarking the trees and cutting the cleaned and debarked trees into strands up to twelve inches long, drying the strands and coating the strands with a formaldehyde-free adhesive. The coated strands are then aligned parallel to each other to take advantage of the natural strength of the wood and passed through a steam injection pressing process which laminates the strands into solid billets of wood up to four and a half inches thick. The billets can then be cut to specification. Some primary known uses for such engineered wood product are studs, joists, headers and rim board in conventional building framing, and as a structural composite lumber substrate for use in the core of wood doors, because it combines the screw holding and bending properties of lumber with the engineered stability of a particleboard core. One benefit of this structural wood product is that small trees can be used and the demand is lessened for harvesting trees from valued and protected old growth forests. However, one drawback with the engineered lumber is that it is not decorative as formed, i.e. the faces of the finished product are not decorative.

The teachings of U.S. Pat. No. 6,428,871, incorporated by reference herein, however, show that such a structural wood product can be processed to expose a decorative edge grain.

It is known that bamboo has many decorative and structural uses. One benefit of using bamboo is its fast growth and regenerative properties. It is known in the art to produce bamboo products by creating "laminated bars." Raw bamboo is split into pieces, sliced into rectangular form according to the usable thickness of the culn wall, dried, immersed or otherwise coated in a binder material, laminated together, and cemented into section bars after subjecting the laminated slices to heat under pressure. One limitation of this method is that substantial material is wasted, since arc-like sections of bamboo can only be sliced into rectangular pieces. By using one layer of rectangular pieces, the resulting section bars are subject to warping, since the bamboo will bend when infused with moisture. In such circumstances, the bamboo section bar can come unglued and split. To overcome these limitations, bamboo has been "threaded" or cut up into thin threads and the threads are glued and adhered together under pressure. One such method is described in Chinese Patent Application No. 99117809.2 entitled "Method of Reconstructing and Reinforcing Bamboo into Section Bar" (hereinafter "the Chinese Patent"), also incorporated by reference herein. However, it can be argued that the resulting section bars are not distinctly decorative, since compressed bars made from threads of bamboo do not demonstrate any edge grain that is any different than the bar surface itself.

What would be desired, but has not yet heretofore been developed, is a decorative engineered bamboo strand edge grain product and method of manufacturing.

SUMMARY OF THE INVENTION

The present invention provides a method for forming a decorative product from an engineered bamboo product. Sheets or billets of engineered bamboo product are made basically by cutting raw bamboo into strands; drying the bamboo strands; combining the dried bamboo strands with at least one adhesive, forming the dried bamboo strands and adhesive mixture into solid sheets, blocks, or billets under pressure and/or heat, and slicing the sheets, blocks, or billets along an edge to expose an edge grain formed by the edges of the bamboo strands. The sheets can be cut into smaller sections, which can be glued together in a thick stack, and then the thick stack cut along the edge to produce planks or slices. The slices can be attached to a substrate for use in any desired manner. The slices can be further treated to produce a decorative effect. The slices can be edge-glued together to form a sheet having the homogeneous edge surface exposed. The newly formed edge grain sheet can be further laminated to various platforms and substrates to form a decorative edge grain bamboo panel.

BRIEF DESCRIPTION OF THE DRAWINGS

For a more complete understanding of the present invention, reference is made to the following Detailed Description of the Invention considered in conjunction with the accompanying drawings, in which.

Further features and advantages of the invention will appear more clearly on a reading of the following detailed description.

DETAILED DESCRIPTION OF THE INVENTION

The present invention relates generally to a decorative engineered bamboo product and a method of manufacturing the same. One of the unique aspects of the invention is that it exposes the edge or side grain of the engineered bamboo product to create a decorative product and thus provides advantages not obtained in any known existing engineered bamboo products. One such advantage is the stability of the engineered bamboo.

Figure 1:
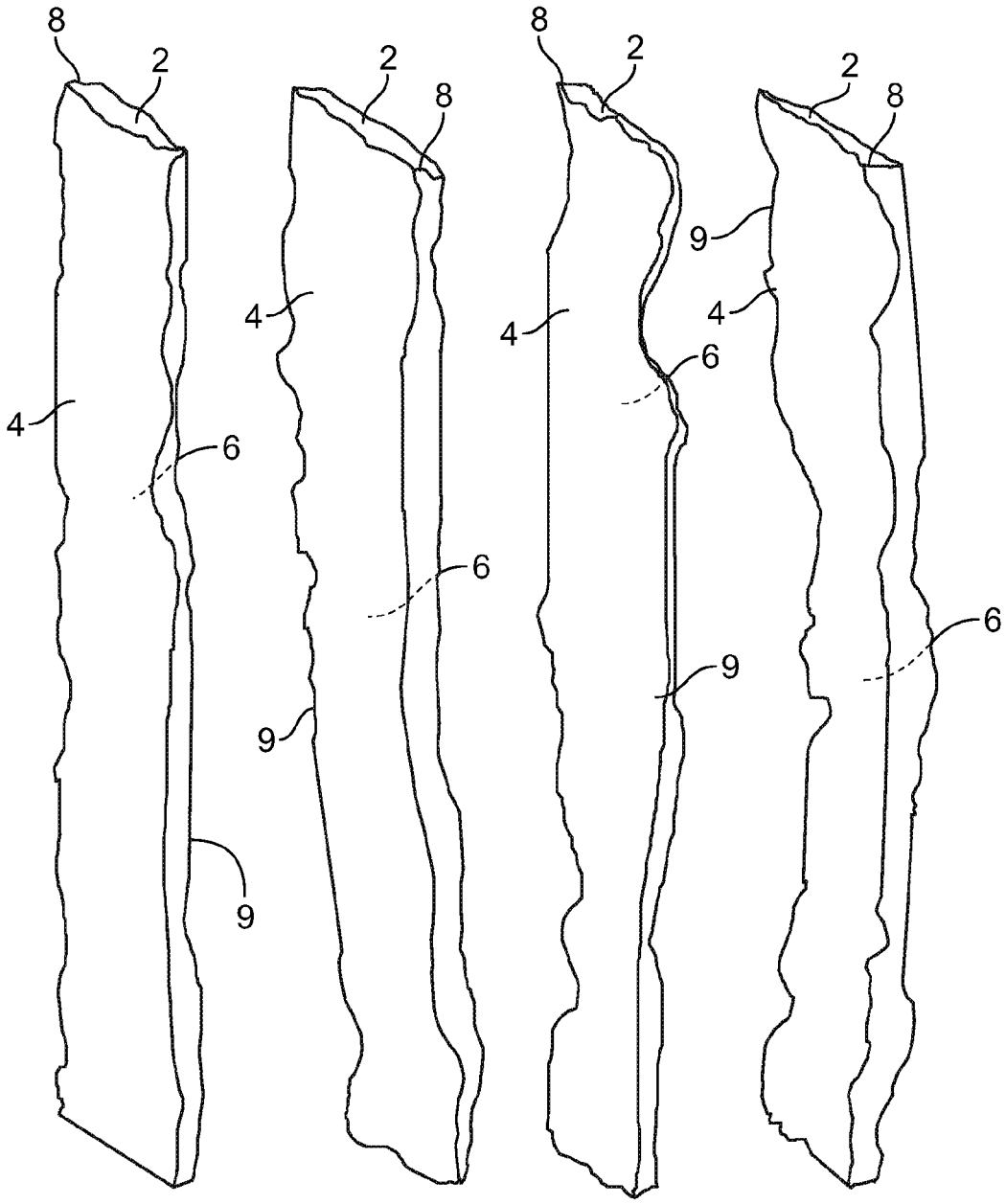
FIG. 1 is a perspective view of a plurality of strands used to form an engineered bamboo product.
Figure 2:
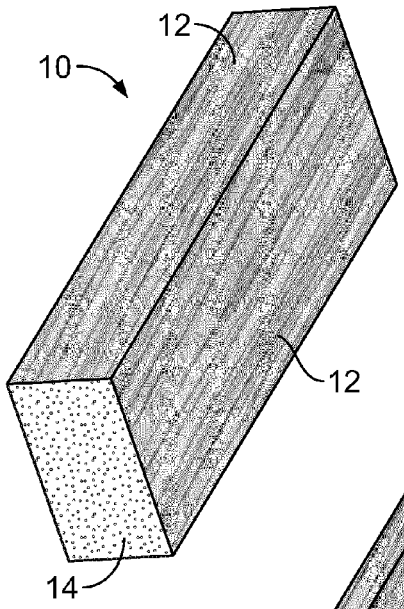
FIG. 2 is a perspective view of a bar or block of engineered bamboo product.
Figure 5:
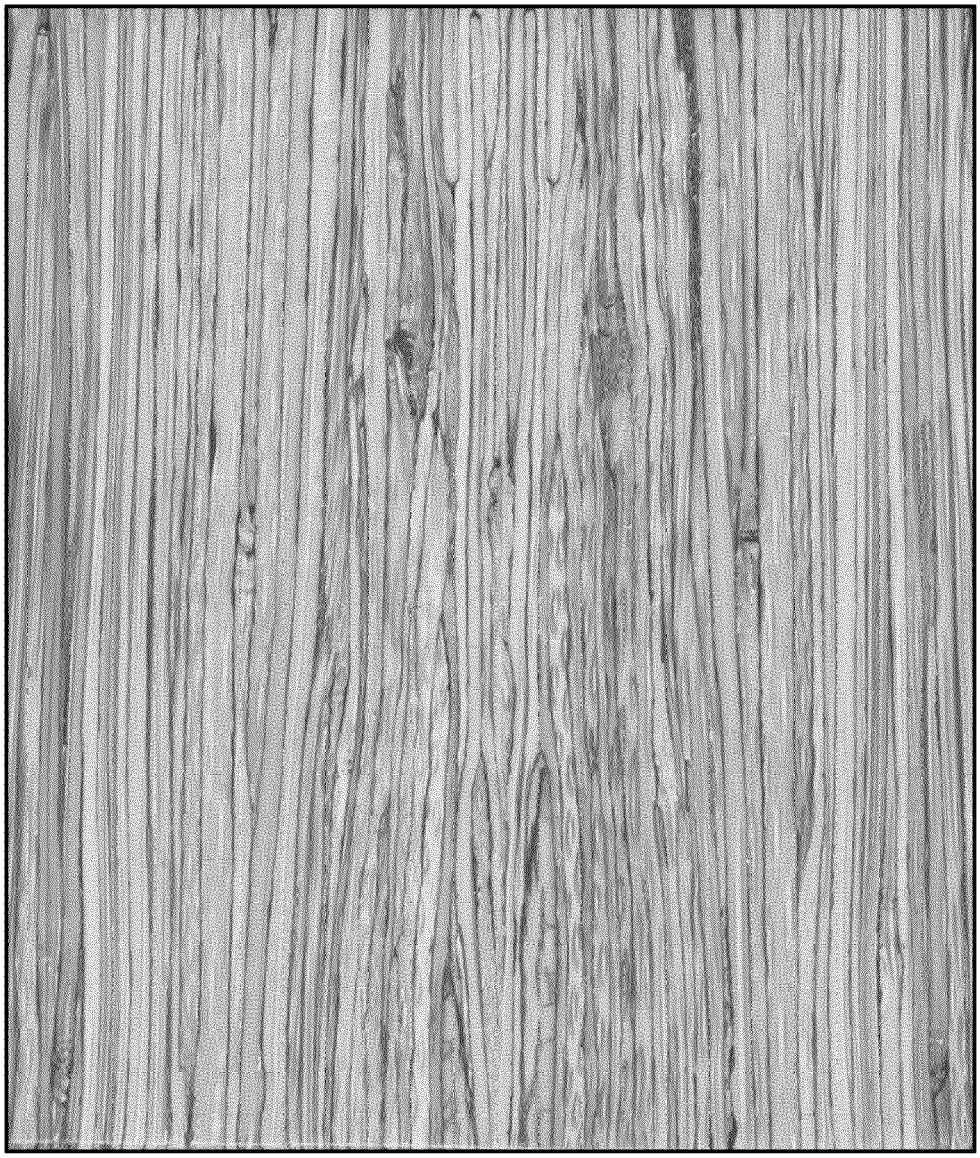
FIG. 5 shows a photograph of an engineered decorative engineered bamboo product according to the present invention.

Referring to FIGS. 1, 2, and 5, an engineered block or stack of bamboo product, which is generally indicated at 10, may be made by a variety of different processes. One particularly appropriate process includes cutting raw bamboo into strands 2 (see FIG. 1), drying the strands, coating the strands 2 with an adhesive, drying the adhesive-coated strands 2 and forming and applying pressure and/or heat to form a solid block 10, or alternatively, a sheet or billet. The manner in which the raw bamboo is cut and the cut bamboo dried is not important to the invention and any commercial process may be used. However, it is preferred that the bamboo maintain the form of discernible strands. Prior to forming the dried bamboo and adhesive mixture into one or more solid blocks, sheets or billets under pressure and/or heat, the strands are preferably aligned, i.e., oriented in the same general direction.

By the term "strand", what is meant for the purposes of the invention disclosed herein is generally an elongated, thin strip or segment of bamboo having relatively wide, generally flat, front and rear faces 4, 6, and relatively narrow side edges or ends 8, 9, one or both of which could terminate in a pointed edge and one or both of which could be non-uniform, i.e., non-linear (see FIG. 1). The strand is a thin, flexible, bendable, pliable portion of the bamboo stalk or culm, as compared to pieces of bamboo which are semi-rigid.

Instead of coating the strands 2 with an adhesive, any other process whereby the strands 2 are engaged with one or more adhesives may be used in accordance with the invention, e.g., wherein the dried bamboo strands are placed into a wet adhesive slurry. Numerous adhesives may be used in the invention. The adhesive is preferably, but not limited to, a phenolic binder, MDI; melamine-formaldehyde, epoxy, or unsaturated resin and applied in various manners, most commonly spraying or submersing into a wet vat. The bamboo blocks can be made in a mold or pressed into a sheet, where the components are heated under pressure, preferably to a pressure about 10 MPa to about 100 MPa. In some embodiments, the components, i.e., the bamboo strands and adhesive(s), may only be heated without a direct application of pressure in order to form the block 10 while in others, the components may only be subjected to pressure without a direct application of heat. In one particular embodiment though, the bamboo strands and adhesive(s) are subjected to a direct application of heat and simultaneously subjected to pressure. Various machines to subject organic material mixed with an adhesive simultaneously to both heat and pressure are known to those skilled in the art.

The outer surfaces 12, 14 of the blocks 10 do not generally present a novel appearance. However, if properly processed according to the present invention, the side or edge grains formed by the narrow edges 8, 9 of the strands 2, can be exposed to provide an appealing decorative surface. The present invention is designed to take advantage of the appealing side or edge grain by exposing the same. The side or edge grain is not inherent to the bamboo in the product, rather, it is the narrow edges 8, 9 of the strands that resemble and therefore replicate wood or decorative grains.

Figure 3:
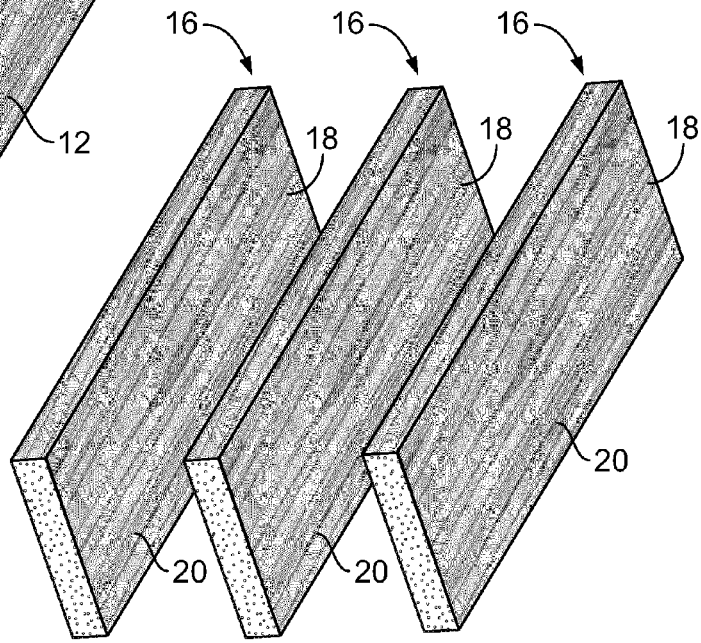
FIG. 3 shows the engineered bamboo product of FIG. 2 cut into slices to expose the edge grain of the product.
Figure 4:
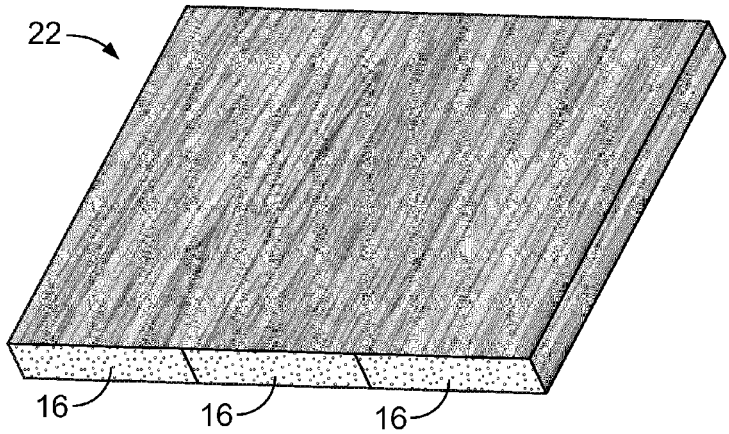
FIG. 4 shows a plurality of slices of FIG. 3, lined up to form a surface of exposed side or edge grain.

Referring now to FIGS. 3 and 4, to attain this objective, the block 10 is cut up along an edge into slices 16, each slice 16 having a surface 18 with exposed side or edge grain 20 formed by the narrow edges 8, 9 of the bamboo strands therein. As shown in FIG. 4, the slices 16 can be positioned side-by-side to form a large area of a decorative bamboo product 22. Importantly, when placed side by side, the slices 16 form a large area of the decorative engineered bamboo product 22 wherein the seams between slices 16 are not visible. Alternatively, the slices 16 may be used individually to provide a decorative bamboo product.

The block 10 may be cut along a long edge, i.e., an edge that extends longitudinally in a direction of the elongate block 10 and thus along the surfaces of the block 10 formed by the relatively wide front and rear faces 4, 6 of the bamboo strands, to expose on each slice 16, edge grains formed by the relatively narrow edges 8, 9 of the bamboo strands.

The slices 16 can be laminated to various substrates and core materials, such as various types of engineered multilayer bamboo platforms, plywood, including flake board, MDF, or the like. The lamination process could take place in a hot press. The substrate is typically four feet wide and can be sawn or otherwise cut into four and a quarter inch sticks or blanks and can be machined so that they can be interconnected by means of a tongue and groove, as is known in the industry.

Further, the slices 16 can be utilized, as desired, to form any decorative engineered bamboo product, including, but not limited to, panels, moldings, furniture, etc. Slices three inches or less in width can be used for strip flooring, and slices of three inches or greater in width can be used for plank forming. Numerous slices can be created simultaneously through resawing the engineered bamboo block product 10 into the slices 16. The slices 16 can then be backed for stability and integrity and used as planks to run through flooring lines to side and end match thereby producing plank or strip flooring directly from the bamboo product 10.

Importantly, it may be desirable to treat the exposed side grain of the decorative engineered bamboo product 22. First, a planer or calibration sander may be used to preliminarily finish dress the surface. A planer is essentially an aggressive sander with straight or rotary blades which will provide a generally smooth surface to the decorative engineered bamboo product 22. The planer can be followed-up with successive sanding grits until the surface is suitably smooth. Thereafter, the decorative engineered bamboo product 22 can be finished on a finish line with an Ultra Violet (UV) cured urethane finish as is currently well known in the flooring industry. Thereafter, the surface can be installed as it is known to install any prefinished wood floor.

Further, the decorative engineered bamboo product 22 can be finished with a stain, such as a translucent stain or a clear coat with a two component urethane floor finish. Again, the product can be finished in accordance with what is known in the industry.

For creating interesting effects, a wire wheel brush, overhead CNC router, or a sand blaster can be utilized to machine groove or to open up the porous surface, which could be used as a visual or acoustical attenuation element, or the grooves can be refilled with various desired materials, which could have various desired colors. With this devices, or other devices, the upper, porous surface may be decorating by gouging and refilling with desired materials. Examples of such materials include wood floor fillers, UV fillers, pigmented polyesters, and liquid or solid epoxy compounds. Then, the decorative engineered bamboo product 22 could be sanded again and top coated to create effects and utilize colors to obtain different styles of wood-like bamboo product. One such design could be a fluted chisel look wherein grooves are "chiseled" into the decorative engineered bamboo product 22 and the grooved decorative engineered bamboo product 22 could be re-filled to highlight the chiseled effect.

In another embodiment of the invention, a decorative engineered wood product is formed from two layers of slices, wherein the slices 16 in an upper layer are positioned on and transverse or perpendicular to the slices in a lower layer (other angles than 90 degrees are also possible). The upper and lower layers may be attached by any known process, e.g., lamination. The upper layer is machined to expose the lower layer, e.g., by forming openings in the upper layer, and thereby exposing the perpendicular grains in the lower layer. These openings may be filled with clear or translucent or colored resin, the filled openings sanded and/or further machined, and then coated with clear resin to produce a decorative panel that has the added benefit of transmitting light through the clear or translucent filled openings. The openings may be in any desired shape, i.e., elongate or meandering grooves.

To create wall or ceiling panels, the slices 16 can be edge glued together to create the size sheet needed, and also laminated to various substrates, e.g., any substrates known for this purpose in the art. The surface can be finished in a similar manner as the floor, and can be CNC machined, embossed, or otherwise machined to create a visually interesting, strongly textured surface.

The slices may thus be used in floor applications and in wall covering applications, i.e., for covering nay surface on which a decorative appearance is sought, or for which a covering of the underlying surface is sought. The slices can also be used individually or in combination with one another to form a sound attenuation panel.

The density of the engineered material allows it to be carved and machined and molded into furniture. However, the finishing of the furniture before sanding generally requires the coating of the surface with wood filler, pigmented polyesters and/or liquid or solid epoxy compounds. The furniture is then sanded down to the original wood for a completely smooth surface. Pieces can then be finished in a manner appropriate to use.

The slices 16 produced in accordance with the present invention can be treated in numerous ways to create a decorative finish and/or to enhance the decorative finish thereof. For example, natural and caramelized bamboo strands can be mixed together in various proportions before gluing and pressing to produce a decorative engineered wood product 22 which has a surface with light and dark shaded portions. Several light and dark surface combinations from all light to all dark can be created by varying the relative proportions of natural to caramelized strands.

As another example, during the formation of the engineered bamboo product blocks 10, wood and/or organic additives can be used to create an engineered multimedia product that has decorative features contained therein. One way to introduce features is to use a wood species or byproduct veneers from the wood industry in the manufacture of the engineered bamboo product blocks 10. Cherry, walnut, maple, mahogany or other wood indigenous to the area where the bamboo is processed can be cut up into strands or threads and added to the bamboo strands forming the engineered bamboo product/block 10 so that after the pressing process, the engineered bamboo/multimedia product/block 10 is created with decorative elements contained therein. This could result in desirable shades and/or decorative colors in the finished product. By including such contrasting and complimenting wood species into the engineered multimedia/bamboo product/blocks 10 the added decorative color will remain unchanged from sanding, refinishing and/or wear of the exposed decorative surface. In this embodiment of the invention therefore, the method may include adding strands of colored wood species to the engineered bamboo product blocks.

Other efforts can be made to build decorative features into the engineered bamboo product/blocks 10. For example, some or all of the strands comprising the engineered bamboo product blocks 10 can be dyed or partially dyed prior to creating the product to add a color or shade into the engineered bamboo product bocks 10. Likewise, a colored glue could be used to impart a color or shade to the engineered bamboo product blocks 10. This could produce a veined or variegated look to the final product.

With respect to the dyeing of the strands, the dyeing process may be performed in order to maximize the aesthetic appeal of the final product. To this end for example, only a portion of the bamboo strands in a single block 10 may be dyed while the remaining bamboo strands are not dyed. Moreover, an embodiment is envisioned wherein a first portion of strands are dyed with one dye or combination of dyes while a second portion of strands, different than the first portion, are dyed with another, different dye or combination of dyes. In this regard, three or more different groups of strands may be dyed with different dyes or combination of dyes to even further increase the variation of the color and/or shade of the product to be obtained using the blocks 10 formed from the dyed strands.

The slices 16 could also be treated by acrylic and color impregnation of the face wear layer of the re-sawn product. For example, Grammapar Acrylic Floors, Inc., of Forest, Va., has a process for acrylic and color impregnation of wood which it sells under the Nydree Group company. This process can be applied to the slices 16 to color and impregnate them. Another impregnation process which can be used is the Polypalm process, a member of the Unimech Group Berhad.

The foregoing provides a method for manufacturing decorative products from bamboo and a method for creating a decorative engineered product with an exposed edge or side grain from stranded and compressed bamboo. Preferably, the bamboo is considered as flat stranded and compressed bamboo because generally accepted terminology of "strand bamboo" refers to long "tubular strands" or "threads" of bamboo.

However, the present invention preferably utilizes flat strands similar to the aspen strands used to make OSB (oriented strand board), SCL (structural Composite Lumber) or LSL (laminated strand Lumber).

It should be understood that the embodiments and variations shown and described herein are illustrative of the principles of this invention and that various modifications may occur to, and be implemented by, those skilled in the art without departing from the scope and spirit of the invention. What is desired to be protected by Letters Patent is set forth in the appended claims.

What is claimed is:

1. A method of forming a decorative bamboo product from an engineered bamboo product, comprising:

cutting raw bamboo into strands; then drying the bamboo strands; then combining the dried bamboo strands with an adhesive, each of the strands including relatively wide front and rear faces and relatively narrow side edges; then aligning the strands such that the relatively wide faces of the strands are against one another; then forming the dried bamboo and adhesive mixture into at least one solid block, sheet, or billet under pressure and/or heat, each having two opposed side surfaces formed by the relatively narrow side edges of the aligned strands and two opposed side surfaces formed by the relatively wide faces of the aligned strands; and then slicing the at least one block, sheet or billet along the opposed side surfaces formed by the relatively wide faces of the aligned strands into slices to provide each slice with opposed side surfaces formed by the relatively narrow edges of the aligned strands, whereby the slices placed individually or in combination with one another provide a decorative bamboo product.

2. The method of claim 1, further comprising attaching a plurality of the slices adjacent one another to a substrate.

3. The method of claim 1, further comprising finishing the opposed side surfaces formed by the relatively narrow edges of the aligned strands by wire brushing or by sand blasting.

4. The method of claim 3, further comprising filling grooves formed by the wire brushing or the sand blasting with a colored material to provide a decorative effect.

5. The method of claim 3, further comprising utilizing the finished side surfaces as a sound attenuation panel.

6. The method of claim 1, further comprising adding decorative elements to the bamboo strands prior to applying pressure and/or heat to form the engineered bamboo product blocks.

7. The method of claim 6, wherein the step of adding decorative elements to the bamboo strands comprises adding strands of colored wood species to the engineered bamboo product blocks.

8. The method of claim 6, wherein the step of adding decorative elements comprising dying the strands prior to forming the decorative engineered bamboo product.

9. The method of claim 1, wherein each of the plurality of slices has an upper surface, the upper surface being decorated by gouging and refilling with desired materials.

10. The method of claim 1, further comprising:

laminating a first layer of the decorative edge grain bamboo surface together on top of and transverse to a second layer of the decorative edge grain bamboo surface; and altering the first layer to create openings in the first layer through which the underlying second layer is exposed.

11. The method of claim 10, further comprising:

filling the openings in the first layer with clear or translucent or colored resin;

sanding or otherwise machining the filled openings in the first layer; and coating the first layer with clear resin to produce a decorative panel that transmits light through the filled openings.

12. The method of claim 1, wherein the step of combining the dried bamboo strands with the adhesive comprises placing the dried bamboo strands into a wet adhesive slurry.

13. The method of claim 1, wherein the step of combining the dried bamboo strands with the adhesive comprises coating the dried bamboo strands with adhesive.

14. The method of claim 1, wherein the step of forming the dried bamboo and adhesive mixture into the at least one solid block, sheet, or billet under pressure and/or heat comprises forming the dried bamboo and adhesive mixture into the at least one solid block, sheet, or billet only under pressure and not under heat.

15. The method of claim 1, wherein the step of forming the dried bamboo and adhesive mixture into the at least one solid block, sheet, or billet under pressure and/or heat comprises forming the dried bamboo and adhesive mixture into the at least one solid block, sheet, or billet only under heat and not under pressure.

16. The method of claim 1, wherein the step of forming the dried bamboo and adhesive mixture into the at least one solid block, sheet, or billet under pressure and/or heat comprises forming the dried bamboo and adhesive mixture into the at least one solid block, sheet, or billet under simultaneous pressure and heat.

17. The method of claim 1, wherein the step of forming the dried bamboo and adhesive mixture into the at least one solid block, sheet, or billet under pressure and/or heat comprises forming the dried bamboo and adhesive mixture into a plurality of blocks.

18. The method of claim 1, wherein the step of forming the dried bamboo and adhesive mixture into the at least one solid block, sheet, or billet under pressure and/or heat comprises forming the dried bamboo and adhesive mixture into a plurality of sheets.

19. The method of claim 1, wherein the step of forming the dried bamboo and adhesive mixture into the at least one solid block, sheet, or billet under pressure and/or heat comprises forming the dried bamboo and adhesive mixture into a plurality of billets.

* * * * *